US009394863B2

(12) United States Patent
Updike et al.

(10) Patent No.: US 9,394,863 B2
(45) Date of Patent: Jul. 19, 2016

(54) INTEGRATED VACUUM PORT MODULE

(71) Applicant: MANN+HUMMEL GMBH, Ludwigsburg (DE)

(72) Inventors: Gregg Updike, Galesburg, MI (US); Dan Huff, Mattawan, MI (US)

(73) Assignee: MANN+HUMMEL GMBH, Ludwigsburg (DE)

( * ) Notice: Subject to any disclaimer, the term of this patent is extended or adjusted under 35 U.S.C. 154(b) by 219 days.

(21) Appl. No.: 14/184,945

(22) Filed: Feb. 20, 2014

(65) Prior Publication Data

US 2014/0238519 A1 Aug. 28, 2014

Related U.S. Application Data

(60) Provisional application No. 61/770,229, filed on Feb. 27, 2013.

(51) Int. Cl.
*F02M 35/10* (2006.01)

(52) U.S. Cl.
CPC ... *F02M 35/10229* (2013.01); *F02M 35/10347* (2013.01); *F02M 35/10321* (2013.01); *Y10T 137/9029* (2015.04)

(58) Field of Classification Search
CPC ..... F02M 35/00; F02M 35/10321; F02M 35/10347
USPC ..... 137/888, 798; 366/182.4; 251/148; 285/924; 138/116, 117
See application file for complete search history.

(56) References Cited

U.S. PATENT DOCUMENTS

| | | | | | |
|---|---|---|---|---|---|
| 3,648,988 | A * | 3/1972 | Dibert | F02M 19/08 | 261/78.1 |
| 4,074,703 | A * | 2/1978 | Smith | F16L 41/14 | 137/798 |
| 4,144,857 | A * | 3/1979 | Bendig | F02M 31/062 | 123/556 |
| 5,291,916 | A * | 3/1994 | Kloosterman | B60T 17/02 | 137/112 |
| 5,819,776 | A * | 10/1998 | Kephart | B01F 1/0022 | 137/1 |
| 6,035,881 | A * | 3/2000 | Emmerich | B60T 17/02 | 137/113 |
| 7,013,911 | B2 * | 3/2006 | Wass | B63C 9/24 | 137/223 |
| 7,163,023 | B2 * | 1/2007 | Spink | F16K 24/044 | 137/15.26 |
| 7,383,856 | B2 * | 6/2008 | Martiš et al. | B60K 15/035 | 123/518 |
| 2002/0144716 | A1 * | 10/2002 | Engle | A01J 7/00 | 134/22.18 |
| 2003/0137897 | A1 * | 7/2003 | Whiteley | B01F 5/0413 | 366/163.2 |
| 2005/0077373 | A1 * | 4/2005 | Ikeda | B60T 13/52 | 239/34 |
| 2006/0016477 | A1 * | 1/2006 | Zaparackas | B60T 13/52 | 137/112 |
| 2011/0204530 | A1 * | 8/2011 | James | F02M 19/02 | 261/64.1 |

* cited by examiner

*Primary Examiner* — John K Fristoe, Jr.
*Assistant Examiner* — Christopher Ballman
(74) *Attorney, Agent, or Firm* — James Hasselbeck

(57) ABSTRACT

An integrated vacuum port module includes a base 12 and a mounting feature secured to the base and operable to form an airtight connection with a housing 14. A first tubular conduit 28 is secured to the base 12 forming a flow passage extending through the base 12 from an exterior to interior side. A second tubular similarly secured to the base 12 forming a flow passage extending through the base 12. A flow port, pressure sensing port or exhaust port 22 is fluidically connected to and secured to at least one of the tubular conduits 28,30 and arranged within the housing 14.

12 Claims, 5 Drawing Sheets

14
10
A
A

Fig. 5
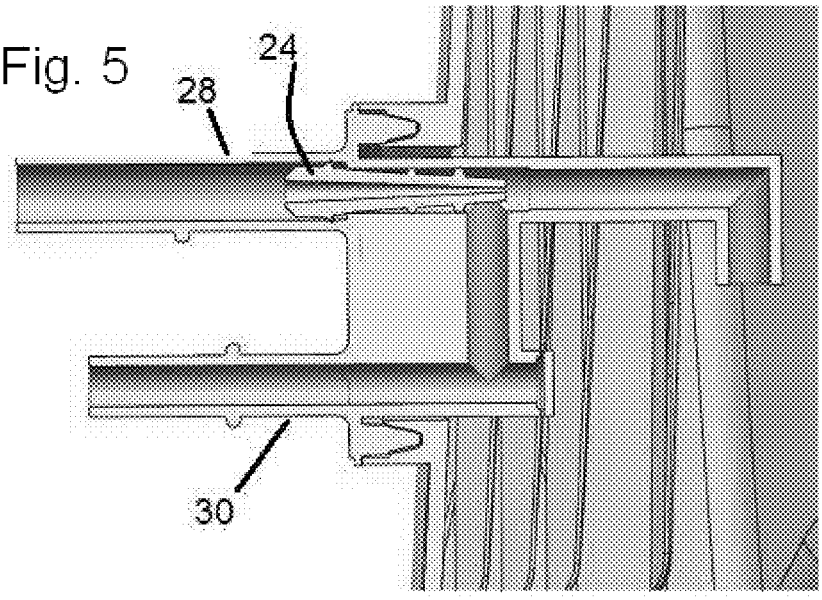
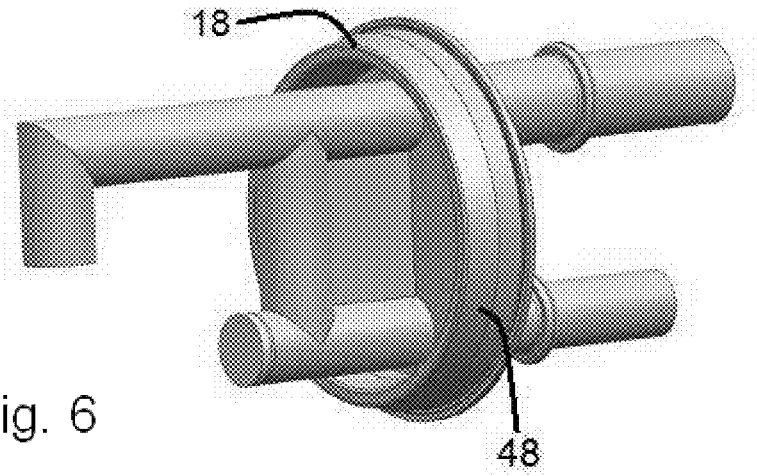
Fig. 6

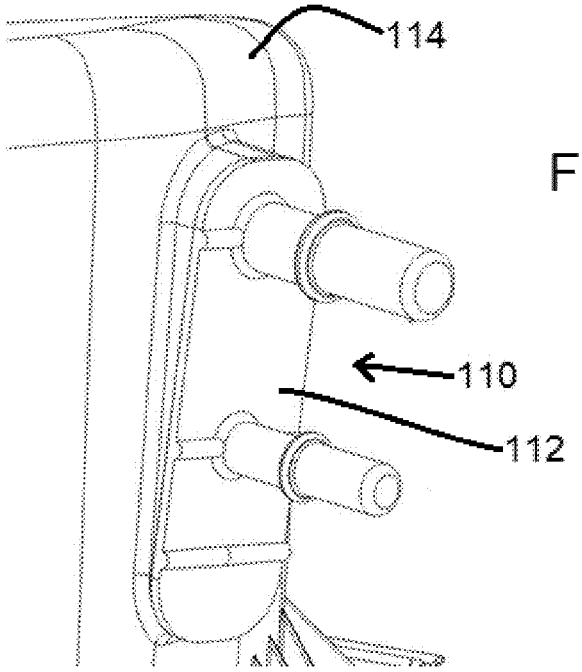
Fig. 7
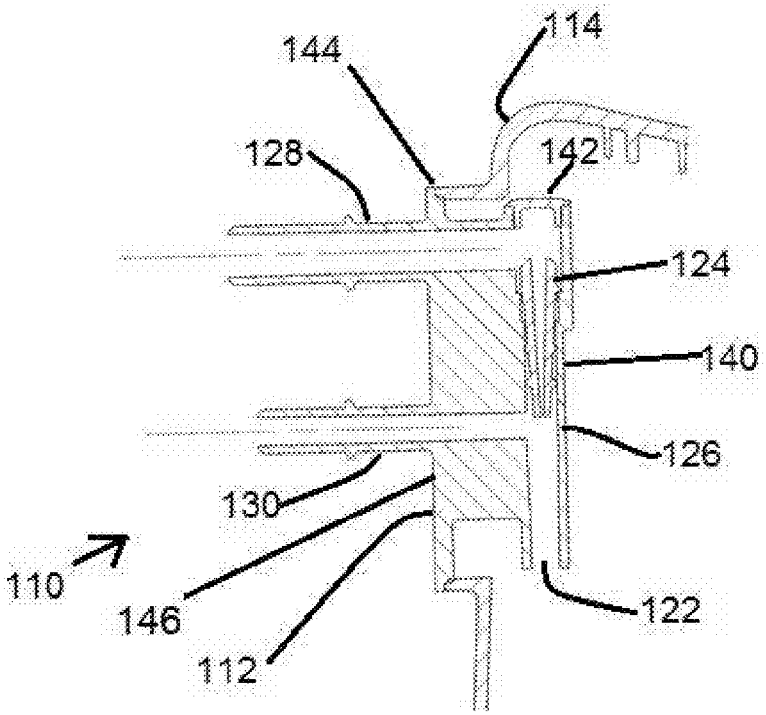

INTEGRATED VACUUM PORT MODULE

CROSS-REFERENCE TO RELATED APPLICATION

This application claims the benefit of U.S. Provisional Application No. 61/770,229 filed Feb. 27, 2013.

TECHNICAL FIELD

The invention relates to an integrated vacuum port module passing multiple ports through an aperture in the wall of an air induction system and, more particularly to an air intake system having an integrated vacuum port module passing multiple ports through the wall of an air filter housing in an air induction system of an internal combustion engine.

BACKGROUND OF THE INVENTION

Air induction systems provide filter intake to support fuel combustion in internal combustion engines. Similar systems may be used to provide filter air for uses such as air compressors, stationary engines, farm and construction equipment and the like.

Typically such air induction systems may include molded plastic air ducts and housings, such as produced by injection molding or blow molding techniques.

SUMMARY OF THE INVENTION

An object of the present invention to provide an integrated vacuum port module configured to pass multiple flow and/or pressure communication ports from the exterior to an interior of an air induction system conduit or air induction system filter housing.

In another aspect of the invention, the integrated vacuum port module may be a unitary one-piece module configured to be secured onto an outside wall of an air induction system component.

In another aspect of the invention, the integrated vacuum port module is a unitary one-piece module configured to be secured onto an outside wall of a molded plastic air induction system component while allowing ports to be fixed to both sides of the air induction system wall without the requirement of providing complex dies, lifters or cams normally required in tooling and molds to produce such air induction system components.

In another aspect of the invention, the integrated vacuum port module enables an easy reconfiguration of an air induction system to provide a differing configuration of vacuum, flow or press sensing ports without the changes affecting the air induction component(s) onto which the integrated vacuum port module is secured and without affecting the tooling and molds producing the air induction system components.

In another aspect of the invention, the integrated vacuum port module allows for design and manufacturing flexibility for a variety of pass through vacuum/pressure/flow port designs allowing multiple configurations while maintaining a single base design for the air induction system components.

In another aspect of the invention, the integrated vacuum port module enables a cost effective, environmentally friendly solution for attaching pass through ports providing pre-assembly or connections on both the exterior side and the interior side of the air induction system component in designs where such a feature would not be possible due to plastic molding tooling constraints and constraints of the injection molding or blow molding processes themselves.

In another aspect of the invention, the integrated vacuum port module is securely and permanently mounted onto a wall of an air filter housing within an air induction system.

In another aspect of the invention, the integrated vacuum port module may include a base having an exterior side and an interior side and having a mounting weld feature secured to the base and operable to form an air tight, flow tight connection with an air induction housing onto which the integrated vacuum port module is installable. A first tubular conduit secured to the base and forms a flow passage extending through the base from the exterior side to the interior side. A second tubular conduit is secured to the base, the second tubular conduit and base forming a flow passage extending through the base from the exterior side to the interior side. A crossover conduit fluidically connects the first tubular conduit and the second tubular conduit within the housing. An exhaust port is fluidically connected to and secured to at least one of the tubular conduits and arranged within the housing.

In another aspect of the invention, the integrated vacuum port module provides multiple port connections in a one piece unitary component and within a small space, wherein the integrated vacuum port module is a separate component from the air induction system component or air filter housing and wherein the unitary component provides multiple ports entering the outer wall of the induction system component or air filter housing through a single opening in the outer wall.

In some applications the invention may be advantageously applied to provide a port system that re-circulates unburned gases from the air intake system and returns the gases for combustion.

The invention may be configured to provide simple external connections via an SAE J2044 quick connect, however the invention is not limited to this style connector and could be fitted to any style connection as required by the application.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

FIGS. 4 and 5 are a side sectional views of the integrated vacuum port module as best shown in presented in FIG. 2;

FIG. 6 is a perspective view of the integrated vacuum port module as best shown in presented in FIG. 2;

FIG. 7 is a perspective view of the exterior of an air filter housing having an integrated vacuum port module according to a further aspect of the invention; and FIG. 8 depicts a side section view of the integrated vacuum port module and housing of FIG. 7 showing features of the integrated vacuum port module, consistent with the present invention.

Figure 1:
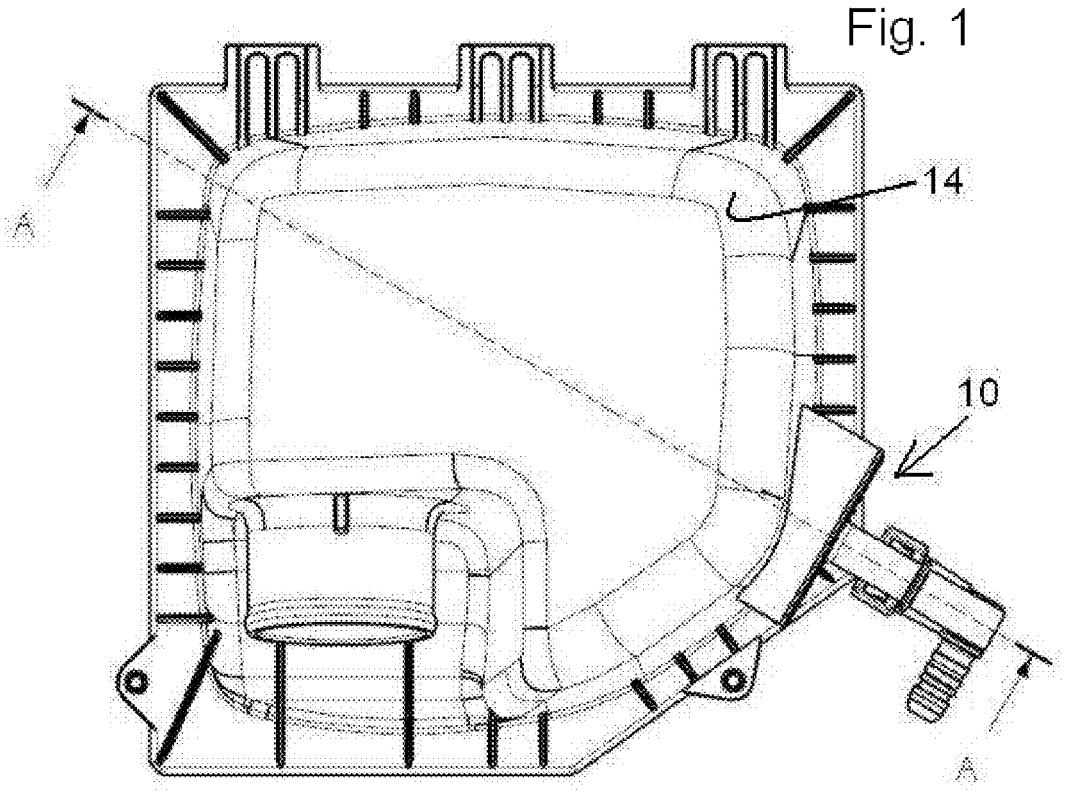
FIG. 1 depicts a top view of an air filter housing having an integrated vacuum port module, consistent with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of module components related to an integrated vacuum port module for an induction system. Accordingly, the module components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or module that comprises a list of elements does not include only those elements but may include other elements not expressly listed or inherent to such process, method, article, or module. An element preceded by "comprises . . . a" does not, without more constraints, preclude the existence of additional identical elements in the process, method, article, or module that comprises the element.

FIG. 1 depicts a top view of an air filter housing, such as housing cover 14, having an integrated vacuum port module 10 secured thereto.

Figure 2:
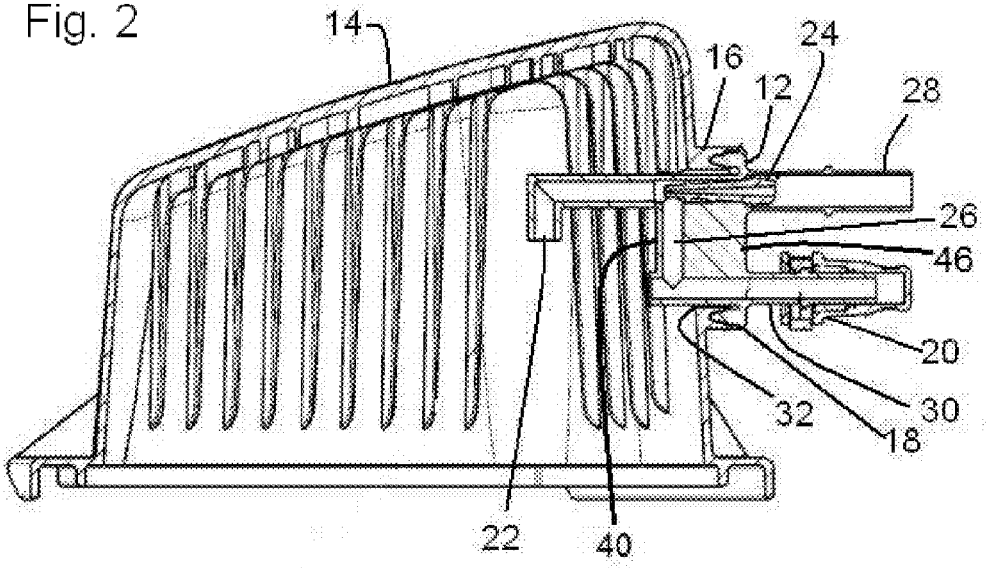
FIG. 2 is a side section view along A-A of FIG. 1 showing features of the integrated vacuum port module, consistent with the present invention.
Figure 3:
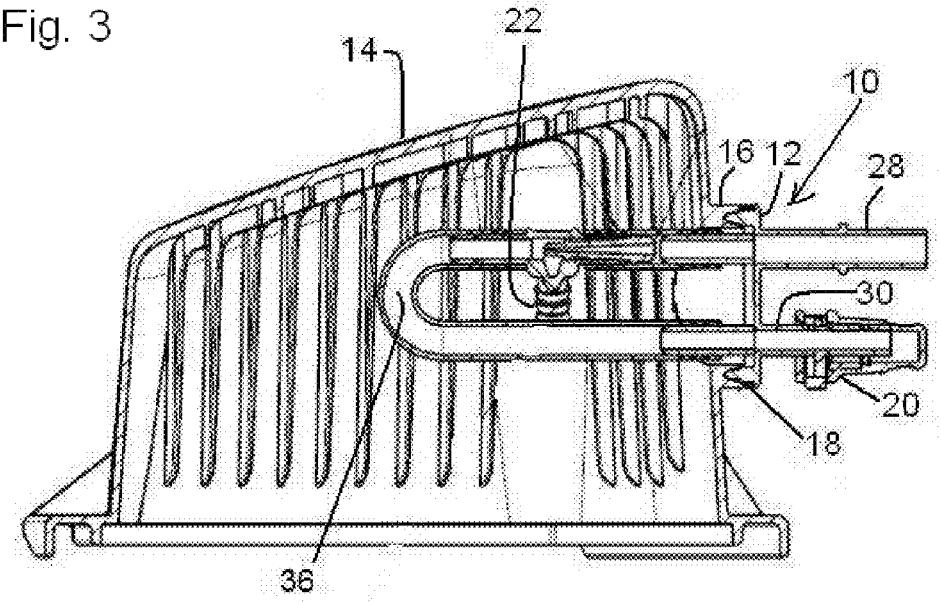
FIG. 3 is a side section view along A-A of FIG. 1 showing features of another aspect of the integrated vacuum port module, consistent with the present invention.
Figure 4:
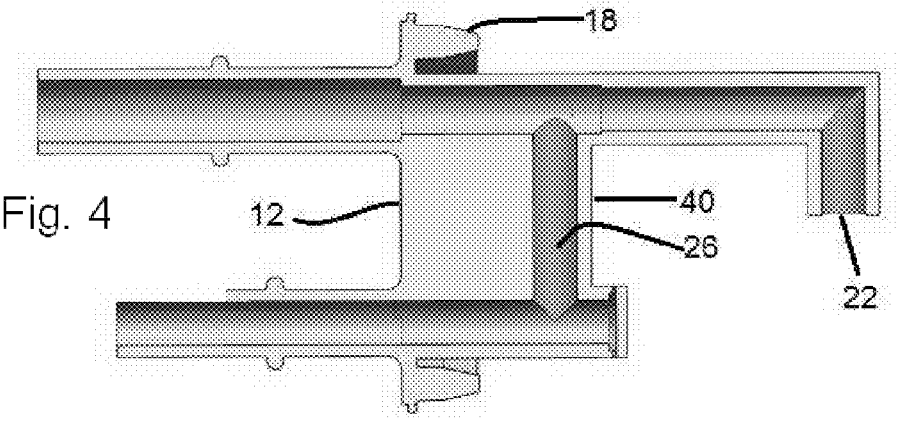

FIGS. 2 and 3 are side section views along A-A of FIG. 1 showing features of the integrated vacuum port module 10 and housing 14, consistent with aspects of the present invention. The integrated vacuum port module includes a base 12 having an exterior side 46 and an interior side 40 (opposing side facing the interior of the housing 14). The integrated vacuum port module 10 has a mounting feature or (in some aspects) a weldable mounting feature secured to the base and operable to form an air tight, flow tight connection with an air induction housing 14 onto which the integrated vacuum port module 10 is installable or installed. A first tubular conduit 28 is secured to the base 12, the first tubular conduit 28 and base 12 forming a flow passage extending through the base 12 from the exterior side 46 to the interior side 40. A second tubular conduit 30 is secured to the base 12, the second tubular conduit 30 and base 12 forming a flow passage extending through the base 12 from the exterior side 46 to the interior side 40 of the base 12. A crossover conduit 26, which may be unitarily formed into the base 12, fluidically connects the first tubular conduit 28 and the second tubular conduit 30 within the interior of the housing 14. A flow port, pressure sensing port or exhaust port 22 is fluidically connected to and secured to at least one of the tubular conduits 28,30 and arranged within and opens into the interior of the housing 14.

A venturi module 24 may be received into and integrated into an interior flow chamber of the integrated vacuum port module 10, the venturi module 24 may be removeably inserted and press fit into the chamber and fluidically connected to said first tubular conduit 28, and operable to restrict flow through the first tubular conduit 28 or may be unitary with and integrally formed with the base 12 in the flow passages within the base 12.

The integrated vacuum port module 10 is preferably molded of a plastic material as a monolithic one-piece component and is a separate component from the housing and configured such that the integrated vacuum port module is installable into the housing 14 through the housing opening or aperture 32 of the housing wall as a monolithic one-piece fully assembled component 10.

The crossover connection 26 may be a flexible tube (36 in FIG. 3), such as (for example) a nylon tube, seal-tightly connected to and fluidically interconnecting the first 28 and second 30 tubular conduits within the housing 14. Alternately, the cross connection 36 may be a rigid molded tube or metallic tube. The exhaust port 22 may be arranged on the cross-connection within the housing.

As best seen in FIGS. 2 3, 4 and 6 taken together, the mounting weld feature 18 of the base 12 may advantageously be a circular annular ring 48 (see Fig. extending axially outwardly from the base 12 (the axial direction herein being the axial elongation direction of the first conduit 28 in FIG. 2), the circular annular ring 18 preferably of a thermally meltable/weldable plastic material operable for spinning in a complimentary groove of the housing wall to the housing to spin weld the base 12 onto the housing 14. Alternately the base 12 may be secured to the housing by other means, for example adhesives or a bayonet connection.

FIG. 7 depicts a perspective view of an air filter housing 114 having an integrated vacuum port module 110 secured thereto.

FIG. 8 is a side section view showing features of the integrated vacuum port module 110 and housing 114, consistent with aspects of the present invention. The integrated vacuum port module includes a base 112 having an exterior side 146 and an interior side 140 (opposing side facing the interior of the housing 114). The integrated vacuum port module 110 has a mounting feature 144 on the flange of the base and having a lip secured to the housing to form an air tight, flow tight connection with the air induction housing 114 onto which the integrated vacuum port module 110 is installable or installed. A first tubular conduit 128 is secured to the base 112, the first tubular conduit 128 and base 112 forming a flow passage extending through the base 112 from 112 exterior side 146 to interior side 140 of the base. A second tubular conduit 130 is secured to the base 112, the second tubular conduit 130 and base 112 forming a flow passage extending through the base 112 from the exterior side 146 to the interior side 140 of the base 112. A crossover conduit 126 is integrally formed into the base 112 and runs transversely to fluidically connect the first tubular conduit 128 and second tubular conduit 130, the A crossover conduit 126 arranged entirely within the interior of the housing 114. A flow port, pressure sensing port or exhaust port 122 is arranged at an end of the crossover conduit 126. The crossover conduit may be provided with a cap 142 arranged an end of the crossover conduit 126 to provide access in the crossover conduit 126 for insertion or removal of the venturi module 124 from the interior of the crossover conduit 126.

The venturi module 124 may be received into and integrated into an interior flow chamber of the integrated vacuum port module 110, the venturi module 24 may be removeably inserted and press fit into the chamber and operable to restrict flow through the first tubular conduit 128 or may be unitary with and integrally formed with the base 112 in the flow passages within the base 112.

The integrated vacuum port module 110 is preferably molded of a plastic material as a monolithic one-piece component and is a separate component from the housing and configured such that the integrated vacuum port module is installable into the housing 114 through the housing opening or aperture 132 of the housing wall as a monolithic one-piece fully assembled component 110.

The integrated vacuum port module 10, 110 tubular conduits 28, 30, 128, 130 may include a quick connect coupler or fitting 20 for connection to vacuum hose or tubing arranged on the exterior of the housing 14, 114.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. An integrated vacuum port module comprising:

a base including an exterior side and an interior side;

a mounting weld feature secured to said base and operable to form an air tight, flow tight connection with an air induction housing onto which said integrated vacuum port module is installable;

a first tubular conduit secured to said base, said first tubular conduit and base forming a flow passage extending through said base from said exterior side to said interior side;

a second tubular conduit secured to said base, said second tubular conduit and base forming a flow passage extending through said base from said exterior side to said interior side;

a crossover conduit fluidically connecting said first tubular conduit and said second tubular conduit installable within said housing;

an exhaust port fluidically connected to and secured to at least one of said tubular conduits installable within said housing;

a venturi module received into an interior flow chamber of said integrated vacuum port module, said venturi module removeably inserted and press fit into said chamber and fluidically connected to said first tubular conduit.

2. The integrated vacuum port module according to claim 1, wherein said mounting weld feature of said base is a circular annular ring extending outwardly from said base, said circular annular ring operable for spin welding said base onto the housing.

3. An integrated vacuum port module, comprising:

a base including an exterior side and an interior side;

a mounting weld feature secured to said base and operable to form an air tight, flow tight connection with an air induction housing onto which said integrated vacuum port module is installable;

a first tubular conduit secured to said base, said first tubular conduit and base forming a flow passage extending through said base from said exterior side to said interior side;

a second tubular conduit secured to said base, said second tubular conduit and base forming a flow passage extending through said base from said exterior side to said interior side;

a crossover conduit fluidically connecting said first tubular conduit and said second tubular conduit installable within said housing;

an exhaust port fluidically connected to and secured to at least one of said tubular conduits installable within said housing;

wherein said crossover conduit comprises a tube seal-tight connected to and fluidically interconnecting said first and second tubular conduits for arrangement within said housing;

wherein said exhaust port is arrange on said crossover conduit within said housing.

4. The integrated vacuum port module according to claim 3, wherein said integrated vacuum port module is a monolithic one-piece component and is a separate component from said housing;

wherein said integrated vacuum port module is installable into said housing as said monolithic one-piece component.

5. The integrated vacuum port module according to claim 3, wherein said mounting weld feature of said base is a circular annular ring extending outwardly from said base, said circular annular ring operable for spin welding said base onto the housing.

6. The integrated vacuum port module according to claim 3, wherein said tubular conduits include quick connect fitting for connection to vacuum hose or tubing.

7. An integrated vacuum port module and air induction housing comprising:

a housing having an exterior wall separating an interior chamber of said housing from an exterior of said housing, said housing have a vacuum port module receiving aperture extending through said exterior wall from said housing exterior into said housing interior chamber;

a mounting flange radially surrounding said vacuum port module receiving aperture on said housing exterior wall;

an integrated vacuum port module comprising:

a base including an exterior side and an interior side;

a mounting weld feature secured to said base and operable to form an air tight, flow tight connection with said air induction housing onto which said integrated vacuum port module is installable;

a first tubular conduit secured to said base, said first tubular conduit and base forming a flow passage extending through said base from said exterior side to said interior side;

a second tubular conduit secured to said base, said second tubular conduit and base forming a flow passage extending through said base from said exterior side to said interior side;

a crossover conduit fluidically connecting said first tubular conduit and said second tubular conduit within said housing; and an exhaust port fluidically connected to secured to at least one of said tubular conduits and arranged within said housing;

wherein said mounting weld feature of said base is secured to said mounting flange in and air tight, seal tight fashion;

a venturi module received into an interior flow chamber of the crossover conduit of said integrated vacuum port module, said venturi module removeably inserted and press fit into said chamber and fluidically connected to said first tubular conduit.

8. The integrated vacuum port module and air induction housing according to claim 7, wherein said mounting weld feature of said base is a circular annular ring extending outwardly from said base, said circular annular ring operable for spin welding said base onto the housing, said spin weld forming an air-tight mounting connection.

9. The integrated vacuum port module and air induction housing according to claim 7, wherein said integrated vacuum port module is a monolithic one-piece component and is a separate component from said housing;

wherein said integrated vacuum port module is installable into said housing as said monolithic one-piece component.

10. An integrated vacuum port module and air induction housing, comprising:

a housing having an exterior wall separating an interior chamber of said housing from an exterior of said housing, said housing have a vacuum port module receiving aperture extending through said exterior wall from said housing exterior into said housing interior chamber;

a mounting flange radially surrounding said vacuum port module receiving aperture on said housing exterior wall;

an integrated vacuum port module comprising:

a base including an exterior side and an interior side;

a mounting weld feature secured to said base and operable to form an air tight, flow tight connection with said air induction housing onto which said integrated vacuum port module is installable;

a first tubular conduit secured to said base, said first tubular conduit and base forming a flow passage extending through said base from said exterior side to said interior side;

a second tubular conduit secured to said base, said second tubular conduit and base forming a flow passage extending through said base from said exterior side to said interior side;

a crossover conduit fluidically connecting said first tubular conduit and said second tubular conduit within said housing; and an exhaust port fluidically connected to secured to at least one of said tubular conduits and arranged within said housing;

wherein said mounting weld feature of said base is secured to said mounting flange in and air tight, seal tight fashion;

wherein said crossover conduit comprises a tube seal-tight connected to and fluidically interconnecting said first and second tubular conduits within said housing;

wherein said exhaust port is arrange on said crossover conduit within said housing.

11. The integrated vacuum port module and air induction housing according to claim 10, wherein said tubular conduits include quick connect fitting for connection to a vacuum hose or tubing exterior to said housing.

12. The integrated vacuum port module and air induction housing according to claim 10, wherein said mounting weld feature of said base is a circular annular ring extending outwardly from said base, said circular annular ring operable for spin welding said base onto the housing, said spin weld forming an air-tight mounting connection.

* * * * *